US009236697B2

(12) United States Patent
Zeng

(10) Patent No.: US 9,236,697 B2
(45) Date of Patent: Jan. 12, 2016

(54) ELECTRICAL CONNECTOR HAVING TERMINALS WITH CONTACT PORTIONS WIDER THAN WELDING PORTIONS AND BENDING DOWNWARD

(71) Applicant: LOTES CO., LTD, Keelung (TW)

(72) Inventor: Xiao Feng Zeng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/575,728

(22) Filed: Dec. 18, 2014

(65) Prior Publication Data

US 2015/0200505 A1 Jul. 16, 2015

(30) Foreign Application Priority Data

Jan. 10, 2014 (CN) ..... 2014 2 0013346 U

(51) Int. Cl.
*H01R 24/64* (2011.01)
*H01R 24/62* (2011.01)
*H01R 107/00* (2006.01)

(52) U.S. Cl.
CPC ..... *H01R 24/62* (2013.01); *H01R 24/64* (2013.01); *H01R 2107/00* (2013.01)

(58) Field of Classification Search
CPC ..... H01R 24/60; H01R 24/62; H01R 24/64; H01R 24/66; H01R 24/86; H01R 2107/00; H01R 25/00
USPC ..... 439/676
See application file for complete search history.

(56) References Cited

U.S. PATENT DOCUMENTS 8,702,452 B2 * 4/2014 Tai ..... H01R 13/6461 439/108
8,708,718 B2 * 4/2014 Li ..... H01R 4/027 439/108
9,033,738 B2 * 5/2015 Wang ..... H01R 13/6471 439/607.08
9,184,545 B2 * 11/2015 Chen ..... H01R 31/06
2013/0323970 A1 * 12/2013 Wang ..... H01R 13/6471 439/607.08
2014/0004753 A1 * 1/2014 Tai ..... H01R 13/6461 439/676

* cited by examiner

*Primary Examiner* — Chandrika Prasad
(74) *Attorney, Agent, or Firm* — Locke Lord LLP; Tim Tingkang Xia, Esq.

(57) ABSTRACT

An electrical connector includes an insulating body, and a first and second terminal groups located in the insulating body. The first and second terminal groups are formed by a material strip through integral stamping and tearing. Two neighboring terminals in the first terminal group and the second terminal group are staggered with each other in the vertical direction. The first terminal group includes a first differential signal terminal pair. Each first differential signal terminal of the first differential signal terminal pair has a first welding portion connected to the material strip, and a first contact portion exposed from the insulating body. The width of the first contact portion is greater than that of the first welding portion. The first contact portion bends downward and extends to form a pre-pressing portion. A space between the pre-pressing portions is less than a space between the first contact portions.

11 Claims, 7 Drawing Sheets

ELECTRICAL CONNECTOR HAVING TERMINALS WITH CONTACT PORTIONS WIDER THAN WELDING PORTIONS AND BENDING DOWNWARD

CROSS-REFERENCE TO RELATED APPLICATION

This non-provisional application claims priority under 35 U.S.C. §119(a) on Patent Application No. 201420013346.0 filed in P.R. China on Jan. 10, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector with reduced electromagnetic interference.

BACKGROUND OF THE INVENTION

In an ordinary electronic product, and in particular in a notebook computer, a general purpose of product design is achieving the most variety of functions within a minimum volume space. Currently, electronic technologies are rapidly developing, such that the computer form develops from a desktop computer into a notebook computer which is small in volume and convenient for carrying. The notebook computers are widely spread at each corner of the society. When a user performs data or signal transmission or connects the notebook computer to another peripheral device, the user needs the so-called peripheral device interface, and a universal serial bus (USB) is used the most generally and widely.

The conventional USB 2.0 has technical problems such as an insufficient transmission speed and an insufficient driving and operating power. In the industry, the foregoing problems are solved by adding a row of USB 3.0 terminal group to the existing USB 2.0 connector. However, when this connector is in operation, and in particular, at a high frequency, a crosstalk unavoidably occurs between the USB 2.0 terminals and the USB 3.0 terminals, thereby affecting signal transmission quality.

The USB 2.0 terminals and the USB 3.0 terminals commercially available in the market are generally formed on different material strips separately through stamping, and then assembled or integrally formed in an insulating body. This technique unquestionably requires two groups of material strips. During material folding, two groups of scraps are generated, such that the material cannot be used economically, and the production cost is increased. Further, a large quantity of production time is consumed, and the production efficiency is reduced.

Therefore, a heretofore unaddressed need exists in the art to address the aforementioned deficiencies and inadequacies.

SUMMARY OF THE INVENTION

In one aspect, the present invention is directed to an electrical connector that reduces electromagnetic interference, saves production cost, and improves production efficiency.

In one embodiment, an electrical connector includes an insulating body, and a first terminal group and a second terminal group located in the insulating body. The first terminal group and the second terminal group are formed by a same material strip through integral stamping and tearing. Two neighboring terminals in the first terminal group and the second terminal group are staggered with each other in the vertical direction. The first terminal group includes a first differential signal terminal pair. Each first differential signal terminal of the first differential signal terminal pair has a first welding portion connected to the material strip, and extends a first contact portion exposed from the insulating body. The width of the first contact portion is greater than that of the first welding portion. The first contact portion bends downward and extends to have a pre-pressing portion. The space between the pre-pressing portions is less than the space between the first contact portions.

In one embodiment, the pre-pressing portion bends and extends in a direction toward the material strip.

In one embodiment, the pre-pressing portion bends and extends in a direction away from the material strip.

In one embodiment, a front end of the pre-pressing portion is provided with a pre-breaking portion, and the width of the pre-breaking portion is less than that of the pre-pressing portion.

In one embodiment, each first differential signal terminal further includes a first retaining portion located between the first welding portion and the first contact portion, and the space between the first retaining portions is equal to the space between the first welding portions.

In one embodiment, each first differential signal terminal further includes a first retaining portion located between the first welding portion and the first contact portion, and the space between the first retaining portions is less than the space between the first welding portions.

In one embodiment, the second terminal group includes two second differential signal terminal pairs and a second grounding terminal located between the two second differential signal terminal pairs. The second grounding terminal has a third retaining portion, and the width of which is equal to the space between the first welding portions.

In one embodiment, one end of the third retaining portion extends to have a third welding portion connected to the material strip, and the other end thereof extends to have a third contact portion exposed from the insulating body.

In one embodiment, each second differential signal terminal sequentially has a second welding portion connected to the material strip, a second retaining portion bending and extending from the welding portion, and a contact portion bending and extending from the second retaining portion and exposed from the insulating body. The two second retaining portions in each pair of the second differential signal terminal pairs offsets toward each other, so that the space between the second retaining portions is less than the space between the second welding portions.

In one embodiment, the first terminal group further includes a first grounding terminal and a power supply terminal separately located at two sides of the first differential signal terminal pair. The first grounding terminal and the power supply terminal respectively have a fourth retaining portion and a fifth retaining portion located between the second differential signal terminal pairs, so that the width of the fourth retaining portion and the width of the fifth retaining portion are equal to the space between each pair of the second retaining portions.

In one embodiment, one end of the fourth retaining portion and one end of the fifth retaining portion respectively extend a fourth welding portion and a fifth welding portion connected to the material strip, and the other end of the fourth retaining portion and the other end of the fifth retaining portion respectively extend a fourth contact portion and a fifth contact portion exposed from the insulating body.

Compared with the related, certain embodiments of the present invention, among other things, have the following beneficial advantages.

1. The pre-pressing portions offsets toward each other, so that the space between the pre-pressing portions is less than the space between the first contact portions, which increases the signal strength between the first differential signal terminal pair, and enhances the anti-electromagnetic interference capability of the first differential signal terminal pair.

2. The first terminal group and the second terminal group are formed by a same material strip through integral stamping and tearing, thereby reducing material waste, saving production time, reducing production cost, and improving production efficiency.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
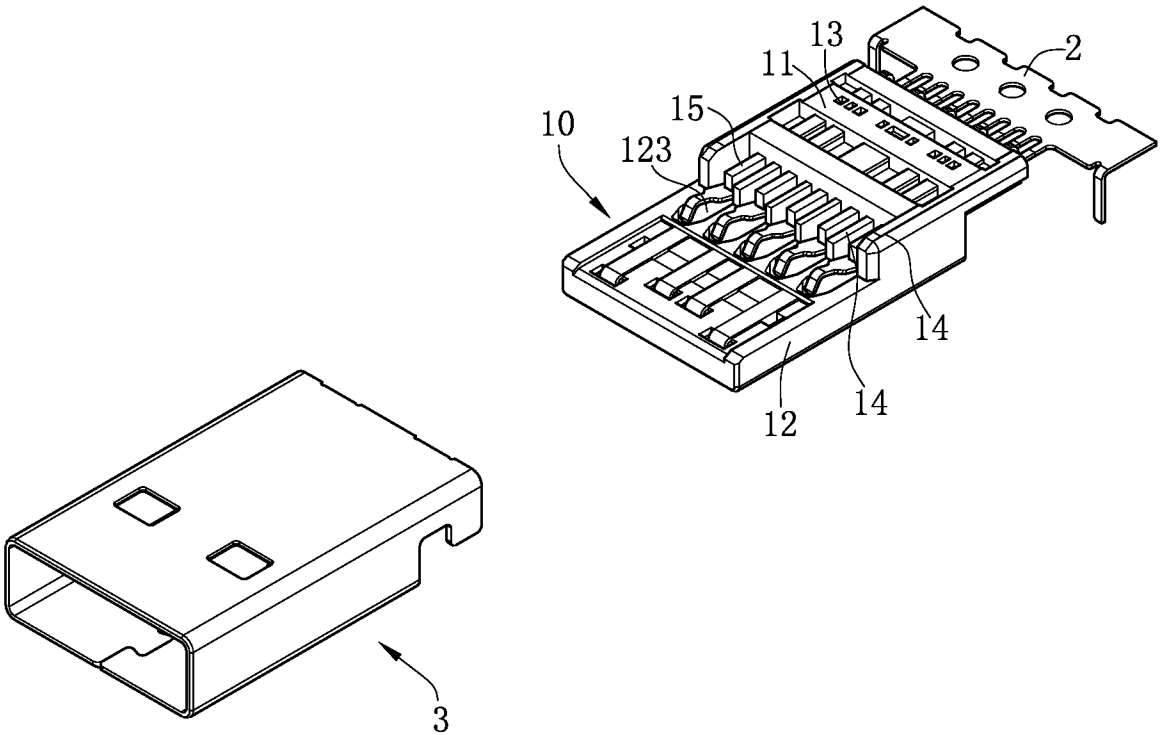
FIG. 1 is a schematic exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

As shown in FIGS. 1 and 3-5, an electrical connector according to one embodiment of the present invention includes an insulating body 10, and a first terminal group 21 and a second terminal group 22 formed by a same material strip 2 through integral stamping and tearing. The first terminal group 21 and the second terminal group 22 are integrally insert-injection-molded in the insulating body 10, and neighboring terminals in the first terminal group 21 and the second terminal group 22 are staggered with each other in the vertical direction.

Figure 6:
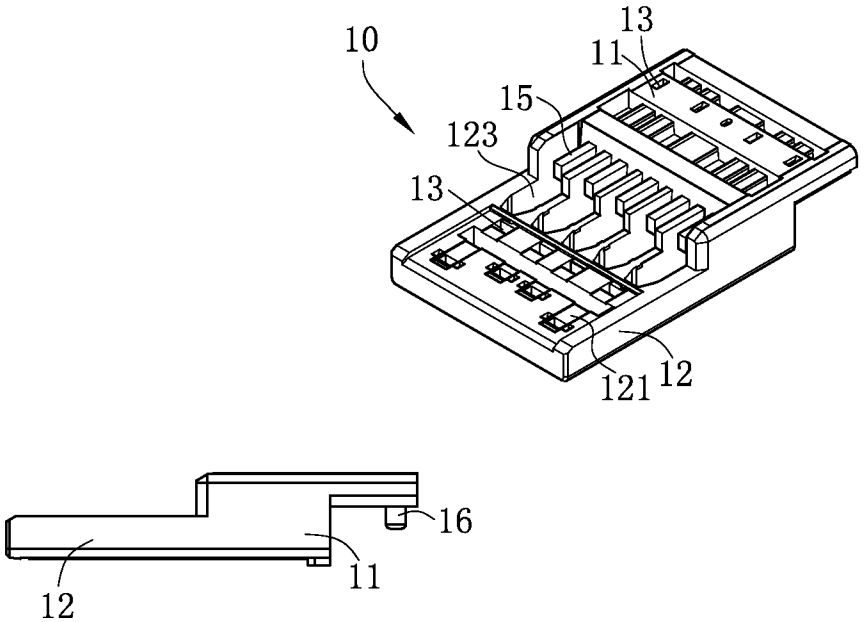
FIG. 6 is a schematic three-dimensional view of an insulating body of an electrical connector according to one embodiment of the present invention.
Figure 7:
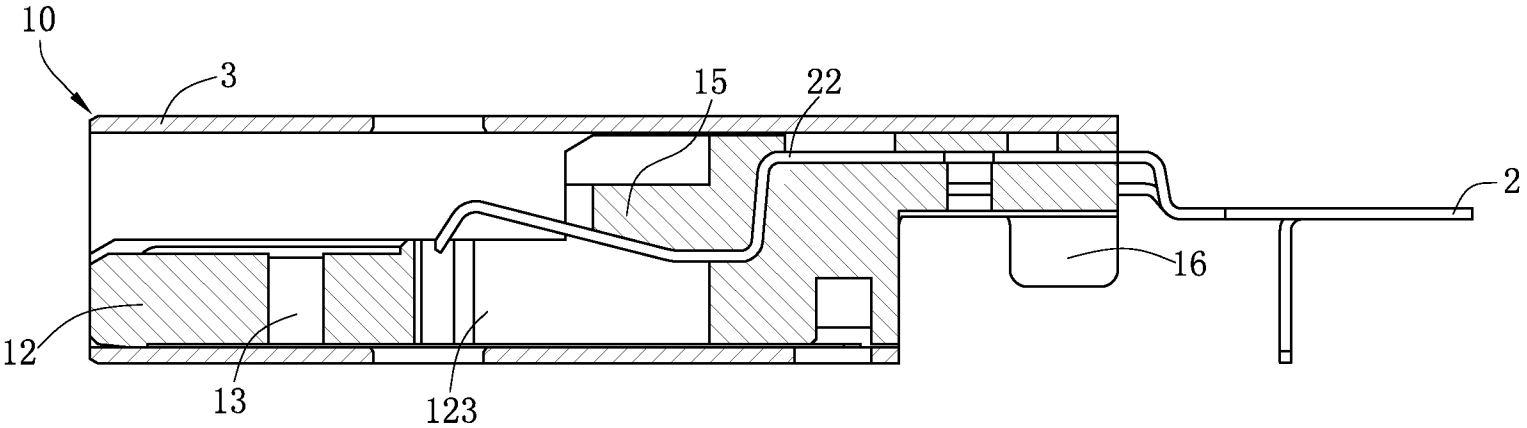
FIG. 7 is a sectional view of an electrical connector according to one embodiment of the present invention.

As shown in FIGS. 1, 6, and 7, the insulating body 10 includes a base 11 and a tongue 12 extends forward from the base 11. The base 11 and the tongue 12 are each provided with multiple positioning holes 13. The positioning holes 13 play a role of positioning when the insulating body 10 is injection-molded. A front end of the tongue 12 has multiple plate-shaped receiving shallow slots 121. Multiple receiving through-slots 123 run through the tongue 12 in an up and down direction and are located behind the receiving shallow slots 121. Two positioning columns 16 are disposed below the base 11. When the electrical connector and a circuit board are electrically assembled, the positioning columns 16 play roles of positioning and limiting. Multiple long ribs 14 and multiple short ribs 15 extend forward from the base 11. The long rib 14 is longer than the short rib 15, and alternatively the long rib 14 may also be as long as the short rib 15. In other embodiments, the long rib 14 may also be shorter than the short rib 15. Two sides of each receiving through-slots 123 are each provided with one of the long ribs 14, and the short rib 15 is located above the receiving through-slot 123.

Figure 3:
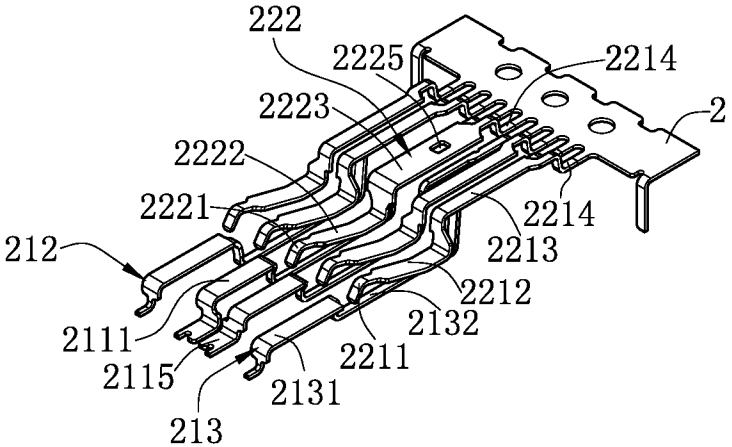
FIG. 3 is a three-dimensional view, a top view and a side view of a terminal of an electrical connector according to one embodiment of the present invention.
Figure 3:
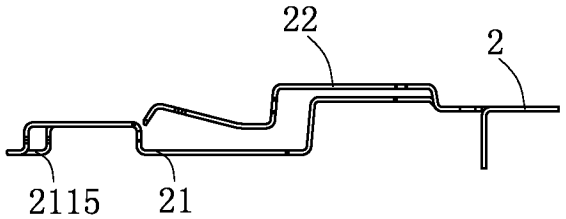
Figure 3:
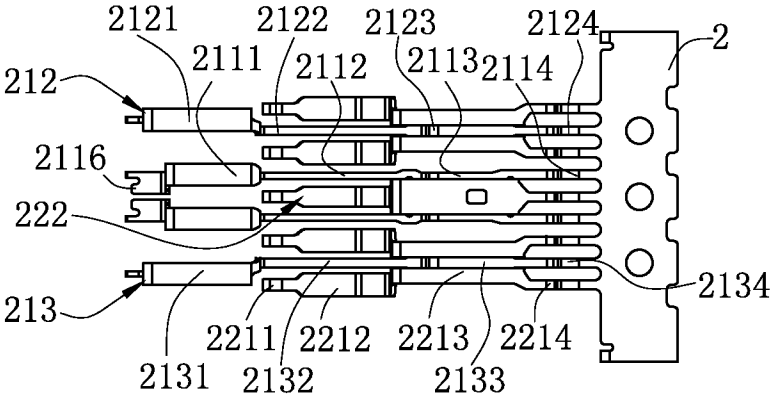
Figure 4:
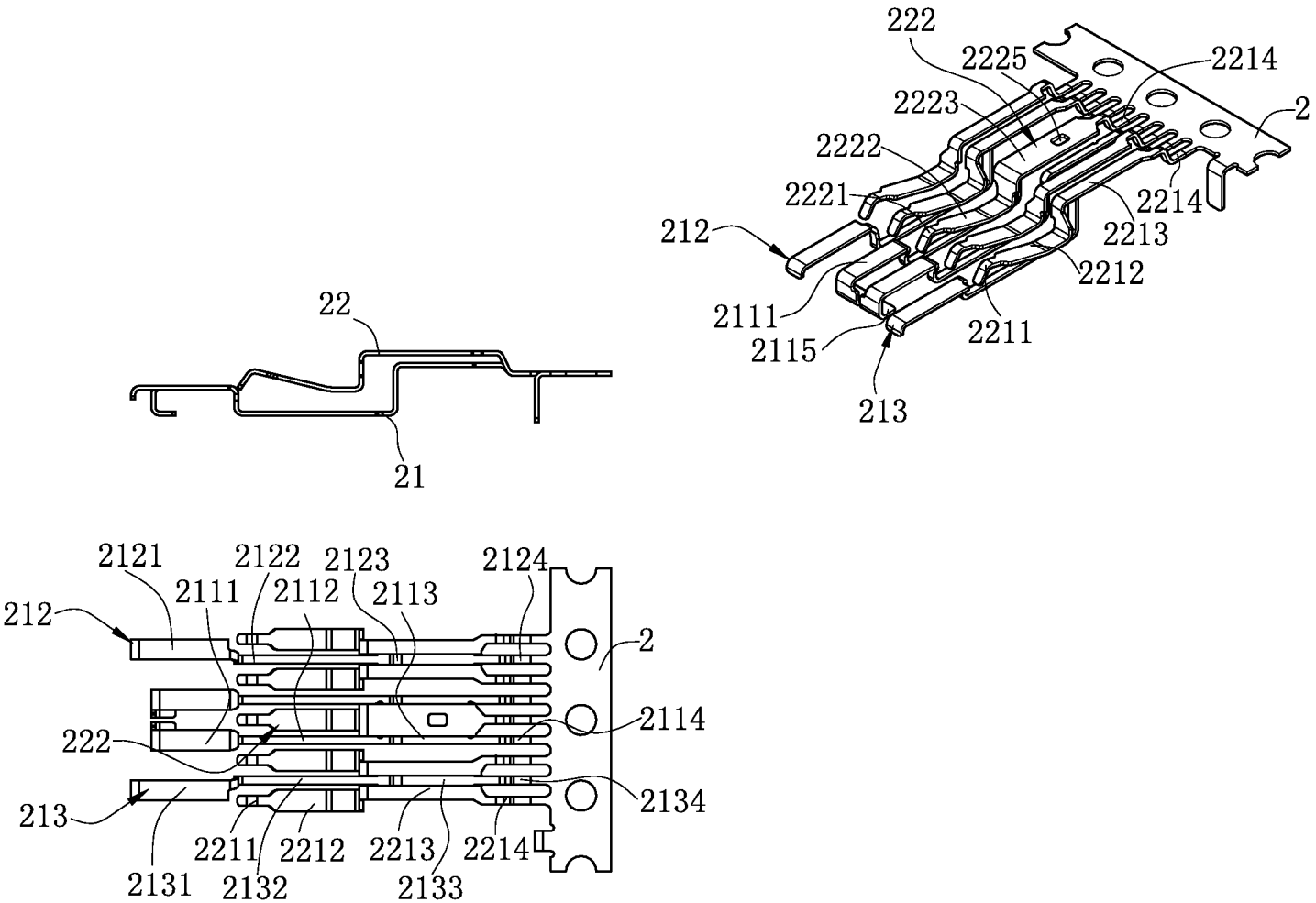
FIG. 4 is a three-dimensional view, a top view and a side view of a terminal of an electrical connector according to one embodiment of the present invention.
Figure 5:
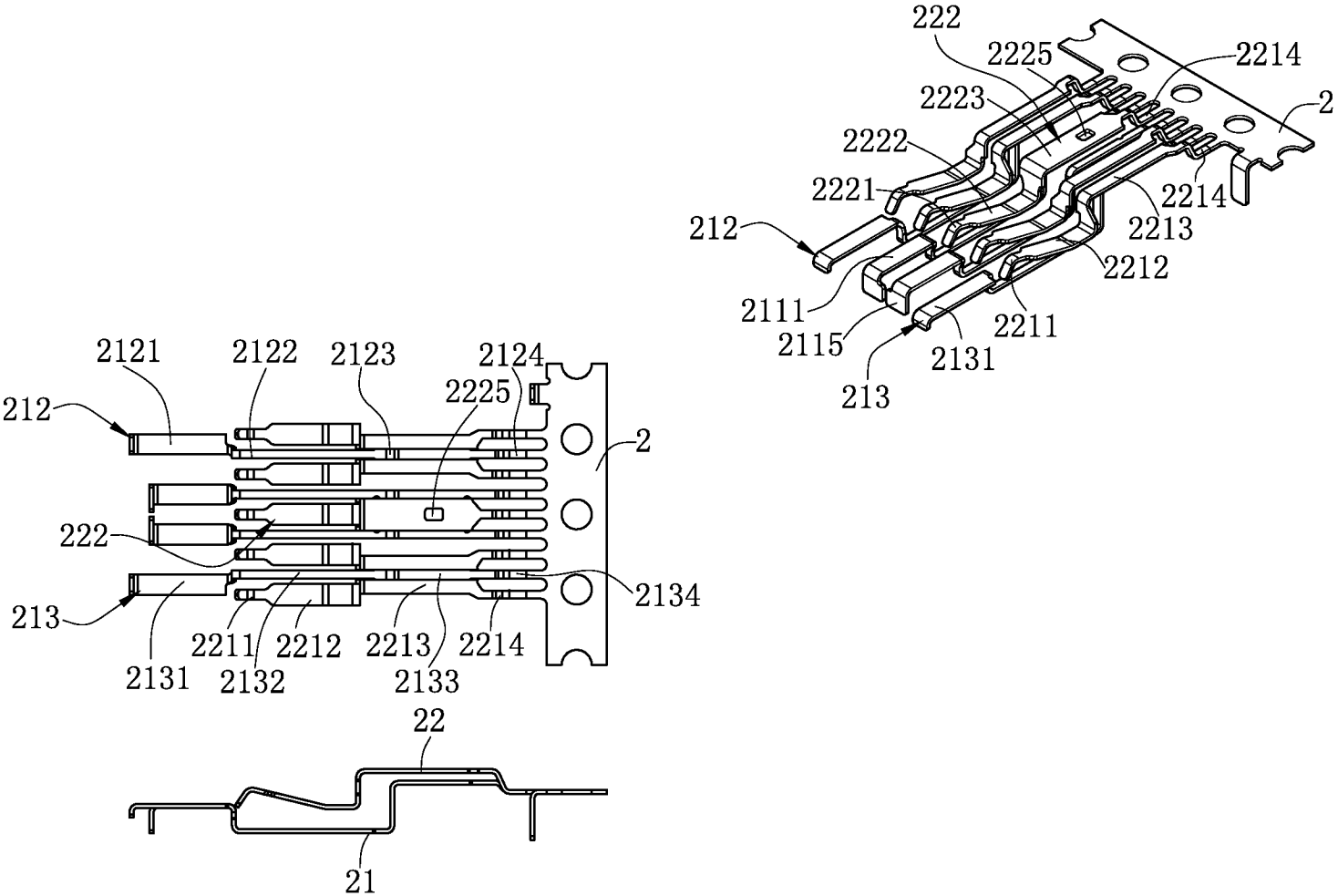
FIG. 5 is a three-dimensional view, a top view and a side view of a terminal of an electrical connector according to one embodiment of the present invention.

As shown in FIGS. 3-5, the first terminal group 21 is formed by four long terminals, including a first differential signal terminal pair 211 located in the middle of the first terminal group 21, and a first grounding terminal 212 and a power supply terminal 213 respectively located at two sides of the first differential signal terminal pair 211. The total length of the first differential signal terminal pair 211 is greater than the total length of the first grounding terminal 212 and the total length of the power supply terminal 213. The first differential signal terminal pair 211 has a first retaining portion 2113 insert-injection-molded in the base 11. One end of the first retaining portion 2113 extends to have a first welding portion 2114 located behind the base 11, exposed out of the base 11, and connected to the material strip 2. The other end thereof extends to have a first contact portion 2111. The first contact portion 2111 has a plate-shaped structure and is accommodated and exposed from the receiving shallow slot 121 (for example, as shown in FIG. 6). A first sinking portion 2112 is insert-injection-molded in the tongue 12. One end of the first sinking portion 2112 bends upward and extends to be connected to the first contact portion 2111, and the other end thereof bends upward and extends to be connected to the first retaining portion 2113. The width of the first contact portion 2111 is greater than the width of the first welding portion 2114. The space between the first retaining portions 2113 is equal to the space between the first welding portions 2114. Alternatively, in order to strengthen signal strength between the first differential signal terminal pair 211, the first retaining portions 2113 shift toward each other, such that the space between the first retaining portions 2113 is less than the space between the first welding portions 2114. The first contact portion 2111 bends downward and extends to have a pre-pressing portion 2115 insert-injection-molded in the tongue 12. The pre-pressing portions 2115 shift toward each other, such that the space between the pre-pressing portions 2115 is less than the space between the first contact portions 2111, thereby increasing the signal strength between the first differential signal terminal pair 211, and reducing electromagnetic interference of the second terminal group 22 to the first differential signal terminal pair 211. In order to enhance the pre-pressing effect of the pre-pressing portion 2115, as shown in FIG. 4, the pre-pressing portion 2115 may bend and extend in a direction toward the first welding portion 2114, or alternatively as shown in FIG. 3, the pre-pressing portion 2115 may also bend and extend in a direction away from the first welding portion 2114. A front end of the pre-pressing portion 2115 further has a pre-breaking portion 2116. The width of the pre-breaking portion 2116 is less than the width of the pre-pressing portion 2115, which can prevent the pre-pressing portion 2115 from being deformed or damaged during material folding.

As shown in FIGS. 3-5, the first grounding terminal 212 and the power supply terminal 213 each have a fourth retaining portion 2123 and a fifth retaining portion 2133 insert-injection-molded in the base 11. One end of the fourth retaining portion 2123 and one end of the fifth retaining portion 2133 respectively extend to have a fourth welding portion 2124 and a fifth welding portion 2134 located behind the base 11, exposed out of the base 11, and connected to the material strip 2. The other end of the fourth retaining portion 2123 and the other end of the fifth retaining portion 2133 respectively extend to have a fourth contact portion 2121 and a fifth contact portion 2131, each of which has a plate-shaped structure and is accommodated and exposed from the receiving shallow slot 121. A fourth sinking portion 2122 and a fifth sinking portion 2132 are each insert-injection-molded in the tongue 12. One end of the fourth sinking portion and one end of the fifth sinking portion 2132 bend upward and extend to be respectively connected to the fourth contact portion 2121 and the fifth contact portion 2131. The other end of the fourth sinking portion 2122 and the other end of the fifth sinking portion 2132 bend upward and extend to be respectively connected to the fourth retaining portion 2123 and the fifth retaining portion 2133. The width of the fourth contact portion 2121 and the width of the fifth contact portion 2131 are respectively greater than the width of the fourth welding portion 2124 and the width of the fifth welding portion 2134, and the length of the fourth contact portion 2121 and the length of the fifth contact portion 2131 are greater than the length of the first contact portion 2111. The fourth contact portion 2121 and the fifth contact portion 2131 symmetrically shifts from each other in a direction away from the first contact portion 2111, such that the space between the fourth contact portion 2121 and the first contact portion 2111 and the space between the fifth contact portion 2131 and the first contact portion 2111 are greater than the space between the first contact portions 2111.

As shown in FIGS. 1 and 3-5, the second terminal group 22 is located above the first terminal group 21, is formed by five short terminals with an equal length, and includes two second differential signal terminal pairs 221 and a second grounding terminal 222 located in the middle of the second differential signal terminal pairs 221. Each of the second differential signal terminals of the second differential signal terminal pairs 221 has a second retaining portion 2213 insert-injection-molded in the base 11. One end of the second retaining portion 2213 extends to have a second welding portion 2214 located behind the base 11, exposed out of the base 11, and connected to the material strip 2. The other end thereof extends to have a second contact portion 2211 accommodated and exposed from the receiving through-slot 123. A second elastic arm 2212 butts against a corresponding short rib 15, and is connected to the second contact portion 2211 and the second retaining portion 2213. The second retaining portions 2213 in each second differential signal terminal pair 221 shift toward each other, such that the space between the second retaining portions 2213 is less than the space between the second welding portions 2214 and the space between the second contact portions 2211 in the second differential signal terminal pair 221. The second grounding terminal 222 has a third retaining portion 2223 insert-injection-molded in the base 11. One end of the third retaining portion 2223 extends to have a third welding portion 2224 located behind the base 11, exposed out of the base 11 and connected to the material strip 2. The other end thereof extends to have a third contact portion 2221 accommodated and exposed from the receiving through-slot 123. A third elastic arm 2222 butts against a corresponding short rib 15 (for example, as shown FIG. 7), and is connected to the third contact portion 2221 and the third retaining portion 2223. The third retaining portion 2223 is provided with a through-hole 2225, which plays a role of positioning during injection molding, and prevents the material strip 2 from deviation during punching.

The second grounding terminal 222 is located in the middle of the first differential signal terminal pair 211. The width of the third retaining portion 2223 is equal to the space between the first retaining portions 2113, the first grounding terminal 212 and the power supply terminal 213 are respectively located in the middle of the corresponding second differential signal terminal pairs 221, and the width of the fourth retaining portion 2123 and the width of the fifth retaining portion 2133 are equal to the space between the second retaining portions 2213.

A first terminal of the first terminal group 21 and a second terminal of the second terminal group 22 are respectively a USB 2.0 terminal and a USB 3.0 terminal.

Figure 2:
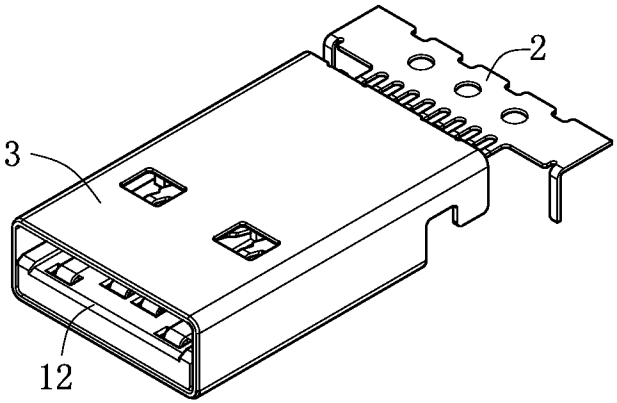
FIG. 2 is a schematic three-dimensional view of the electrical connector according to one embodiment of the present invention.

As shown in FIG. 1 and FIG. 2, the electrical connector according to one embodiment of the present invention further has a metal shell 3 shielding and covering the insulating body 10, and the metal shell 3 can be inserted therein with the circuit board (not shown).

During assembly, as shown in FIG. 1, at first, the first terminal group 21 and the second terminal group 22 are formed by the same material strip 2 through integral stamping and tearing. Afterwards, the first retaining portion 2113, the fourth retaining portion 2123, the fifth retaining portion 2133, the first sinking portion 2112, the fourth sinking portion 2122, and the fifth sinking portion 2132 of the first terminal group 21, and the second retaining portion 2213 and the third retaining portion 2223 of the second terminal group 22 are simultaneously insert-injection-molded in the base 11 and the tongue 12. Then the material strip 2 connected to the first terminal group 21 and the second terminal group 22 are removed through folding with one action. Finally the insulating body 10 is assembled into the metal shell 3.

To sum up, the electrical connector according to certain embodiments of the present invention, among other things, has the following beneficial advantages.

(1) The pre-pressing portions 2115 offsets toward each other, such that the space between the pre-pressing portions 2115 is less than the space between the first contact portions 2111, the signal strength between the first differential signal terminal pair 211 is enhanced, and the anti-electromagnetic interference capability of the first differential signal terminal pair 211 is also enhanced.

(2) The two second retaining portions 2213 offset toward each other, such that the space between the second retaining portions 2213 is less than the space between the second welding portions 2214 and the space between the second contact portions 2211. The two first retaining portions 2113 offset toward each other, such that the space between the first retaining portions 2113 is less than the space between the first welding portions 2114. Thus, the distance between the first differential signal terminal pair 211 and the two second differential signal terminal pairs 221 is enlarged from a slant direction, thereby reducing the mutual electromagnetic interference between the first differential signal terminal pair 211 and the second differential signal terminal pair 221, improving the data transmission rate, and ensuring the high-frequency quality.

(3) The terminals of the first terminal group 21 and the second terminal group 22 formed by the same material strip 2 through integral stamping and tearing are each embedded and integrally formed in the insulating body 10, and then the material strip 2 connected to the first terminal group 21 and the second terminal group 22 is removed through folding with one action, so as to reduce the scrap rate, and meanwhile save half of the time treating the material strip 2, thereby achieving objectives of reducing the production cost and improving the production efficiency.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a first terminal group and a second terminal group respectively located in the insulating body, and formed by a material strip through integral stamping and tearing and, wherein two neighboring terminals in the first terminal group and the second terminal group are staggered with each other in the vertical direction;

wherein the first terminal group comprises a first differential signal terminal pair;

wherein each first differential signal terminal of the first differential signal terminal pair has a first welding portion connected to the material strip, and a first contact portion exposed from the insulating body, and a width of the first contact portion is greater than that of the first welding portion; and wherein the first contact portion bends downward and extends to form a pre-pressing portion, and a space between the pre-pressing portions is less than a space between the first contact portions.

2. The electrical connector according to claim 1, wherein the pre-pressing portion bends and extends in a direction toward the material strip.

3. The electrical connector according to claim 1, wherein the pre-pressing portion bends and extends in a direction away from the material strip.

4. The electrical connector according to claim 1, wherein a front end of the pre-pressing portion is provided with a pre-breaking portion, and a width of the pre-breaking portion is less than that of the pre-pressing portion.

5. The electrical connector according to claim 1, wherein each first differential signal terminal of the first differential signal terminal pair further comprises a first retaining portion located between the first welding portion and the first contact portion, and a space between the first retaining portions is equal to a space between the first welding portions.

6. The electrical connector according to claim 1, wherein each first differential signal terminal of the first differential signal terminal pair further comprises a first retaining portion located between the first welding portion and the first contact portion, and a space between the first retaining portions is less than a space between the first welding portions.

7. The electrical connector according to claim 1, wherein the second terminal group comprises two second differential signal terminal pairs and a second grounding terminal located between the two second differential signal terminal pairs, the second grounding terminal has a third retaining portion, and a width of the third retaining portion is equal to a space between the first welding portions.

8. The electrical connector according to claim 7, wherein one end of the third retaining portion extends to have a third welding portion connected to the material strip, and the other end of the third retaining portion extends to have a third contact portion exposed from the insulating body.

9. The electrical connector according to claim 7, wherein each second differential signal terminal of the second differential signal terminal pairs sequentially has a second welding portion connected to the material strip, a second retaining portion bending and extending from the welding portion, and a second contact portion exposed from the insulating body, and the two second retaining portions of each second differential signal terminal pair offset toward each other, such that a space between the second retaining portions is less than a space between the second welding portions.

10. The electrical connector according to claim 9, wherein the first terminal group further comprises a first grounding terminal and a power supply terminal respectively located at two sides of the first differential signal terminal pair;

wherein the first grounding terminal has a fourth retaining portion, the fourth retaining portion is located in the middle of one pair of the second differential signal terminal pairs, such that a width of the fourth retaining portion is equal to a space between the second retaining portions of the one pair of the second differential signal terminal pairs; and wherein the power supply terminal has a fifth retaining portion, the fifth retaining portion is located in the middle of the other one pair of the second differential signal terminal pairs, such that a width of the fifth retaining portion is equal to a space between the second retaining portions of the other one pair of the second differential signal terminal pairs.

11. The electrical connector according to claim 10, wherein one end of the fourth retaining portion extends to have a fourth welding portion connected to the material strip, and the other end of the fourth retaining portion extends to have a fourth contact portion exposed from the insulating body; and wherein one end of the fifth retaining portion extends to have a fifth welding portion connected to the material strip, and the other end of the fifth retaining portion extends to have a fifth contact portion exposed from the insulating body.

* * * * *